US006493015B2

(12) United States Patent
Bhatt et al.

(10) Patent No.: US 6,493,015 B2
(45) Date of Patent: Dec. 10, 2002

(54) THERMAL RECORDING SYSTEM

(75) Inventors: Jayprakash C. Bhatt, Waltham, MA (US); Hyung-Chul Choi, Lexington, MA (US); F. Richard Cottrell, Westport, MA (US); Anemarie De Young, Lexington, MA (US)

(73) Assignee: Polaroid Corporation, Cambridge, MA (US)

( * ) Notice: Subject to any disclaimer, the term of this patent is extended or adjusted under 35 U.S.C. 154(b) by 0 days.

(21) Appl. No.: 09/821,413

(22) Filed: Mar. 29, 2001

(65) Prior Publication Data

US 2002/0140798 A1 Oct. 3, 2002

(51) Int. Cl.[7] ..... B45J 2/325
(52) U.S. Cl. ..... 347/171; 347/172; 347/176
(58) Field of Search ..... 347/171, 172, 347/174, 176, 224, 173; 430/141, 146, 151; 428/195

(56) References Cited

U.S. PATENT DOCUMENTS

| | | | | | |
|---|---|---|---|---|---|
| 4,469,433 | A | * | 9/1984 | Kurata et al. | 347/172 |
| 4,504,837 | A | | 3/1985 | Toyoda et al. | 346/1.1 |
| 5,170,178 | A | * | 12/1992 | Yokoyama | 347/224 |
| 6,054,246 | A | * | 4/2000 | Bhatt et al. | 430/151 |
| 6,210,794 | B1 | * | 4/2001 | Nakamura | 429/195 |

FOREIGN PATENT DOCUMENTS

JP 2000-343843 * 12/2000

* cited by examiner

*Primary Examiner*—Huan Tran

(57) ABSTRACT

A thermal transfer recording system wherein an area of a thermal transfer imaging medium is heated imagewise while in contact only with a thermal printing head and the imaged area of the thermal transfer recording medium subsequently transferred to a receiver material.

17 Claims, 4 Drawing Sheets

THERMAL RECORDING SYSTEM

BACKGROUND OF THE INVENTION

This invention relates to a thermal recording system. More specifically, this invention relates to a thermal recording system wherein a thermal imaging medium is heated imagewise prior to being brought into contact with a receiver material.

Printers based upon a process known as "thermal wax transfer", or, more correctly, "thermal mass transfer" are available commercially. Such printers use an imaging medium (usually called a "donor sheet" or "donor web") which, in the case of a color printer, comprises a series of panels of differing colors. Each panel comprises a substrate, typically a plastic film, carrying a layer of fusible material, conventionally a wax, containing a dye or pigment of the relevant color. To effect printing, a panel is contacted with a receiving sheet, which can be paper or a similar material, and passed across a thermal printing head, which effects imagewise heating of the panel. At each pixel where heat is applied by the thermal head, the layer of fusible material containing the dye or pigment transfers from the substrate to the receiving sheet, thereby forming an image on the receiving sheet. To form a full color image, the printing operation is repeated with panels of differing colors so that three or four images of different colors are superposed on a single receiving sheet.

Thermal wax transfer printing is relatively inexpensive and yields images which are good enough for many purposes. However, the resolution of the images which can be produced in practice is restricted since the separation between adjacent pixels is at least equal to the spacing between adjacent heating elements in the thermal head, and this spacing is subject to mechanical and electrical constraints. Also, the process is essentially binary; any specific pixel on one donor panel either transfers or does not, so that producing continuous tone images requires the use of dithering, stochastic screening or similar techniques to simulate continuous tone. One version of thermal wax transfer, called variable dot wax transfer, creates gray scale at the pixel level by creating a variable dot. This is accomplished by using a variable dot printhead, which has smaller heating elements, which creates a more peaked thermal gradient in the media. The longer heat is applied at the pixel the larger is the dot formed. It is not necessary to use halftoning with this technique. However, one problem with this technique is that it becomes very difficult to transfer small dots which results in grain and in the loss of detail in the low density regions.

Finally, some difficulties arise in accurately controlling the color of the images produced. The size of the wax particle transferred tends to vary depending upon whether an isolated pixel, or a series of adjacent pixels are being transferred, and this introduces granularity into the image and may lead to difficulty in accurate control of gray scale. Also, the size of the wax particle transferred depends on the thermal properties and surface roughness of the receiving material. Local nonuniformities in these properties in the receiving material introduce granularity into the image. This effect, in turn, requires expensive specialized receiving materials for high quality images. In addition, any given pixel in the final image may have 0, 1, 2, 3 or 4 superimposed wax particles, and the effects of the upper particles upon the color of the lower particles may lead to problems in accurate control of color balance.

Printers are also known using a process known as "dye diffusion thermal transfer" or "dye sublimation transfer".

This process is generally similar to thermal wax transfer in that a series of panels of different colors are placed in succession in contact with a receiving sheet, and heat is imagewise applied to the panels by means of a thermal head to transfer dye from the panels to the receiving sheet. In dye diffusion thermal transfer processes, however, there is no mass transfer of a binder containing a dye; instead a highly diffusible dye is used, and this dye alone transfers from the panel to the receiving sheet without any accompanying binder. Dye diffusion thermal transfer processes have the advantages of being inherently continuous tone (the amount of dye transferred at any specific pixel can be varied over a wide range by controlling the heat input to that pixel of the panel) and can produce images of photographic quality. However, the process is expensive because special dyes having high diffusivity, and a special receiving sheet, are required. Also, this special receiving sheet usually has a glossy surface similar to that of a photographic print paper, and the glossy receiving sheet limits the types of images which can be produced; one cannot, for example, produce a image with a matte finish similar to that produced by printing on plain paper, and images with such a matte finish may be desirable in certain applications. Finally, problems may be encountered with images produced by dye diffusion thermal transfer because the highly diffusible dyes tend to "bleed" within the image, for example, when contacted by oils from the fingers of users handling the images.

Finally, there is a thermal imaging system, described in, inter alia, U.S. Pat. Nos. 4,771,032; 5,409,880; 5,410,335; 5,486,856; and 5,537,140, and sold by Fuji Photo Film Co., Ltd. under the Registered Trademark "AUTOCHROME" which does not depend upon transfer of a dye, with or without a binder or carrier, from a donor to a receiving sheet. This process uses a recording sheet having three separate superposed color-forming layers, each of which develops a different color upon heating. The top color-forming layer develops color at a lower temperature than the middle color-forming layer, which in turn develops color at a lower temperature than the bottom color-forming layer. Also, at least the top and middle color-forming layers can be deactivated by actinic radiation of a specific wavelength (the wavelength for each color-forming layer being different, but both typically being in the near ultra-violet) so that after deactivation the color-forming layer will not generate color upon heating.

This recording sheet is imaged by first imagewise heating the sheet so that color is developed in the top color-forming layer, the heating being controlled so that no color is developed in either of the other two color-forming layers. The sheet is next passed beneath a radiation source of a wavelength which deactivates the top color-forming layer, but does not deactivate the middle color-forming layer. The sheet is then again imagewise heated by the thermal head, but with the head producing more heat than in the first pass, so that color is developed in the middle color-forming layer, and the sheet is passed beneath a radiation source of a wavelength which deactivates the middle color-forming layer. Finally, the sheet is again imagewise heated by the thermal head, but with the head producing more heat than in the second pass, so that color is developed in the bottom color-forming layer.

In such a process, it is difficult to avoid crosstalk between the three color-forming layers since, for example, if it is desired to image an area of the top color-forming layer to maximum optical density, it is difficult to avoid some color formation in the middle color-forming layer. Insulating layers may be provided between the color-forming layers to reduce such crosstalk, but the provision of such insulating layers adds to the cost of the medium. Print energy tends to be high, since the third pass over the thermal head to form color in the bottom color-forming layer requires heating of this layer through two superposed color-forming layers, and two insulating layers, if these are present. Finally, the need for at least two radiation sources to produce two well-separated wavelengths adds to the cost and complexity of the apparatus required.

Generally speaking, the prior art thermal imaging methods involve the application of heat by a thermal imaging head to the donor element while the donor element is in contact with the receiver material. This arrangement is not always completely satisfactory because the amount of energy needed to reach the required imaging temperature is affected by the receiver material, typically paper, and therefore the energy necessary is typically higher. Also, the image quality of the image formed may be adversely affected by non-uniform receiver layer surfaces.

U.S. Pat. No. 4,504,837 describes a method and apparatus for recording color images as color transfer superimposed laminations. In one embodiment described therein imaging is effected by applying heat to a transfer sheet while it is in contact with an ink ribbon to form an image on the transfer sheet and a base sheet is then laminated over the image on the surface of the transfer sheet. In another embodiment (see, for example, FIG. 9 and the discussion beginning at column 7, line 32) three separate color donor elements are imaged by three separate thermal heads before the donor elements are brought into contact with the receiver material but with a roller in contact with the back side of the donor element. Subsequently, the entire coloring layer of the donor element is stripped from the support layer and transferred to a base sheet. In the multicolor embodiment illustrated in FIG. 9 of the '837 patent subsequent color layers are superimposed over the first transferred color layer.

As the state of the art advances and efforts are made to provide new thermal recording systems which can meet new performance requirements and to reduce or eliminate some of the undesirable characteristics of the known systems it would be advantageous to have a thermal recording system wherein the effects of the receiver material upon the energy requirements of the system and on the image quality of the images obtained can be significantly reduced or substantially eliminated.

SUMMARY OF THE INVENTION

It is therefore the object of this invention to provide a novel thermal recording system.

It is another object to provide a thermal recording system wherein the energy required for imaging is not affected by the receiver material on which the image is recorded.

It is still another object of the invention to provide a thermal recording system wherein a thermal imaging medium is heated by a thermal printing head prior to being brought into contact with a receiver material.

Yet another object of the invention is to provide a thermal recording system wherein one surface of a thermal imaging medium is heated by contact with a thermal printing head while the opposite surface of the imaging medium is in contact with air.

A further object of the invention is to provide a thermal recording system wherein an image formed in a thermal image-forming layer can be transferred to a receiver material without the application of any substantial additional heat.

Still another object is to provide a thermal recording system wherein an image formed in a thermal image-forming layer can be transferred to a receiver material and laminated over a previously transferred image or images formed in a thermal image-forming layer or layers without causing any appreciable undesirable further thermal development of the previously transferred image(s).

A further object is to provide a thermal recording system capable of high image quality which permits the use of a broad range of receiving materials.

These and other objects and advantages are accomplished in accordance with the invention by providing a novel thermal recording system wherein a specific area of a thermal imaging medium is imaged by being brought into contact with a thermal printing, or imaging, head and heated imagewise before that imaged area of the imaging medium is brought into contact with a receiver material. According to the invention, during the imagewise heat application step the area of the surface of the thermal imaging medium opposite to the area of the surface in contact with the thermal printing head is in contact only with air. The imaging medium is held firmly against the thermal printing head by tension. Subsequently, at least the imaged areas of the thermal imaging medium are transferred to a receiver material. Thus, the effect of the receiver material upon the energy required to attain the requisite imaging temperature is substantially or completely avoided.

According to a preferred embodiment of the invention, the distance between the point where any specific area of the thermal imaging medium is imaged by the thermal printing head and the point where that specific area of the imaged thermal imaging medium is transferred to a receiver material is selected such that no, or only very little, additional energy is needed to reach the required temperature for transferring the image formed in the thermal imaging medium to a receiver material.

In preferred embodiments of the invention, as will be described in detail below herein, the distance between imaging of the thermal imaging medium and transfer of the image formed in the imaging medium to a receiver material is a function of the length of the surface of the thermal heating element in the thermal printing head, i.e., the length in the print direction (the travel direction of the thermal imaging medium and the receiver element), and is measured from the center of the surface of the thermal heating element. The distance between application of heat to any point on the thermal imaging medium (referred to herein as the "image generation point") to transfer of the image formed in that location to a receiver material (referred to herein as the "image transfer point") is from about two to about six times the length of the surface of the thermal heating element.

The thermal recording system of the invention permits the use of less energy to attain the imaging temperature required by the thermal image-forming material in any particular instance. In a preferred embodiment, an imaging medium comprising a substrate carrying as the thermal image-forming layer a color-change layer which develops color upon heating is utilized and cross-talk between successively transferred, differently colored image-forming layers to form a multicolor image can be avoided without the necessity of fixing the previous image before transferring a subsequent image over it. Further, according to another preferred embodiment the imaged thermal image-forming layer can be transferred to a receiving element with only relatively little or no additional energy being required.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
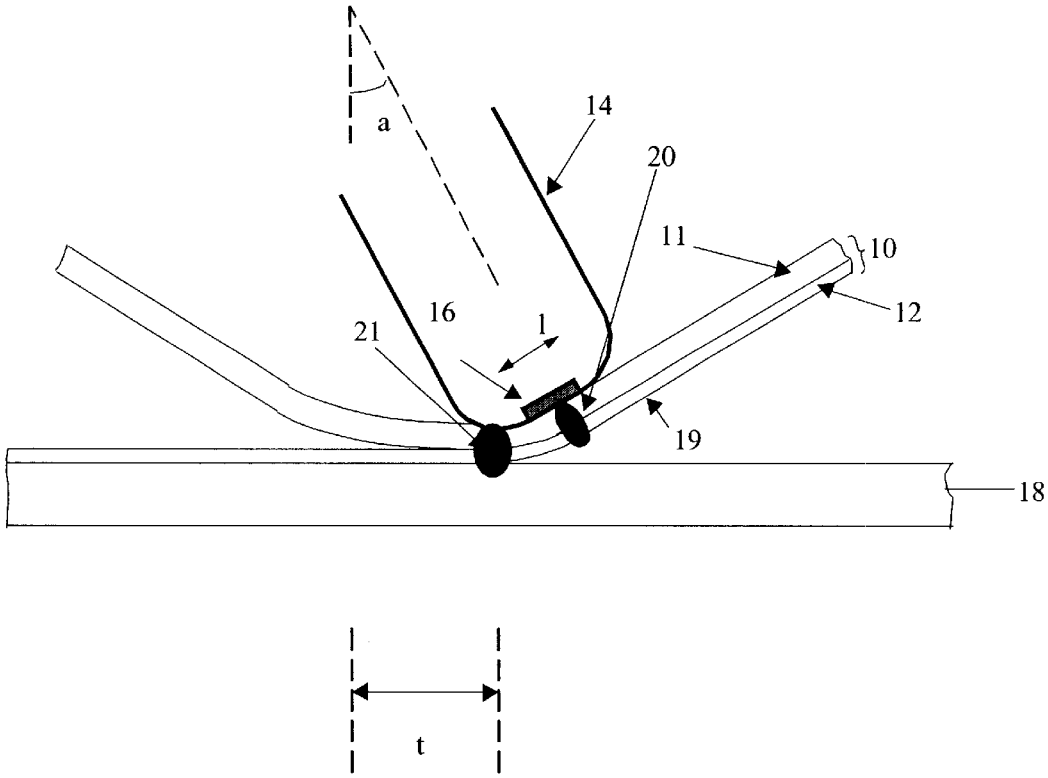
FIG. 1 is a partially schematic side view of one embodiment for carrying out the method of the invention.

The thermal imaging medium which may be utilized in accordance with the invention can comprise any suitable thermal imaging material including those which include a color-change material which develops color upon heating and those which include colored thermal imaging material. Typical suitable thermal transfer imaging media are described in U.S. Pat. Nos. 4,503,095; 5,521,626 and 5,569,347.

For purposes of illustration the invention will be described in detail with respect to the preferred embodiment of the invention wherein there is utilized a thermal imaging medium comprising a color-change element which comprises at least a first layer or phase comprising a first color-forming reagent and a second layer or phase comprising a second color-forming reagent, the two reagents being capable of reacting, upon heating of the medium, to cause a change in the color of the color-change layer. In this method the color-change element can be imagewise heated prior to being brought into contact with the receiver sheet to cause a change, imagewise, in the color of the color change element and the element subsequently transferred to the receiving sheet. The imaging medium can comprise a substrate carrying a plurality of first panels of a first color-change element alternating with a plurality of second panels of a second color-change element and, preferably, with a plurality of third panels of a third color-change element. Alternatively, each color-change element may be carried on separate substrates.

The first and second reagents may be present in two separate sublayers within the color-change element or in two separate phases within the same layer. In some cases it may be desirable to microencapsulate one of the reagents to improve the storage stability of the imaging medium while still maintaining high efficiency in color formation upon heating.

In a preferred embodiment the color-forming reagents used in the color-change layer(s) of the imaging medium are leuco dyes such as lactone leuco dyes. Typical suitable leuco dyes for use in such color-change layers include, for example, Copichem 16, a magenta leuco dye and Copichem 39, a cyan leuco dye available from Hilton-Davis, Cincinnati, Ohio, a magenta leuco dye, Red 40, available from Yamamoto Chemicals, and Pergascript I-3R, a yellow leuco dye, available from CIBA Specialty Chemicals. The dyes are typically used in conjunction with acid developer materials such as, for example, 2,2-bis(p-hydroxyphenyl) propane, and a zinc salt of 3-octyl-5-methyl salicylic acid. For specific examples of such color-change layers see Examples 7 and 8 of U.S. Pat. No. 6,054,246 which are incorporated by reference herein.

In addition to the color-forming reagents, the color-forming layers typically include a binder material. The binders used in conventional thermal wax transfer imaging materials, for example, natural or synthetic waxes or resins, may be used. In a preferred embodiment the color-change layer, or at least one sublayer thereof, may contain an adhesive to assist in the transfer of the color-change layer to the receiver sheet. The color-change layer may also include various optional components for purposes such as modifying the the physical properties of the color-change layer to ensure good adhesion to the substrate layer prior to imaging and effective transfer to the receiving sheet, storage stability, color stability prior to imaging, rate of color formation during imaging, i.e., thermal sensitivity, and good handling properties. Such optional components may include plasticizers, thermal solvents, acid stabilizers, releasing agents and tackifiers, among others. Ultra-violet absorbers may also be incorporated into the last color-change layer transferred to the receiving sheet to improve the light stability of the image.

The exact nature of the substrate used in the color-change imaging medium is not critical provided that the substrate provides adequate mechanical support for the color-change layer during manufacture, storage, transport and imaging has sufficient thermal conductivity so as not to interfere with the imaging process and releases the color-change layer properly when required. In general, the same types of substrates used in conventional thermal wax media can also be used in the imaging materials utilized in the imaging method of the present invention. Typically the substrate will be a thin polymeric film such as Mylar®, available from E. I. duPont de Nemours and Company, Wilmington, Del. A film of this material having a thickness of about 5 $\mu$m or less is a suitable substrate material. In a preferred embodiment, the substrate may be provided with a release layer, such as a wax layer, on the surface which carries the color-change layer.

In another preferred embodiment, the imaging medium includes an adhesive layer overlying the color-change layer to assist in the transfer of the color-change-layer to a receiving sheet. The presence of the adhesive layer can decrease the energy required to transfer the imaged color-change layer to the receiving sheet.

In this illustrative embodiment the heating of the color change elements to cause an imagewise change in the color thereof is carried out at a first thermal energy level ($E_1$) sufficient to cause the desired color change in the element and the imaged color-change element can be transferred to the receiver sheet at a second thermal energy level($E_2$) which is less than the first thermal energy level ($E_1$) such that upon contact of the imaged color-change element with the receiving sheet or with a previously transferred imaged color-change element, the color-change element will be detached from the substrate and adhere to the receiving sheet or the previously transferred color-change element.

It should be noted that the actual color formation in the color-change element(s) may occur prior to, simultaneously with or after transfer of the color-change element to the receiving sheet. For convenience, reference may be hereinafter made to "colored" or "uncolored" areas to denote areas which are colored or uncolored, respectively, in the color-change element in its final form on the receiving sheet, irrespective whether the colored areas have actually developed color at the point in the method being discussed.

Desirably, the color-forming reagents used in this illustrative embodiment of the invention are such that the density of the color developed as a result of the color change in the color-change element varies with the thermal energy input to the element. By using such color-forming reagents and varying the imagewise heating there can be produced in the final image colored areas of the color change element having differing color densities, thus producing a continuous tone image in contrast to an essentially binary image.

In some cases the materials comprising the color-change element may have physical characteristics sufficient to cause the transfer without the necessity for any additional components. For example, if the color-change element includes a wax as a binder or vehicle, heating the wax above its softening point may suffice to effect transfer to an appropriate receiving sheet.

In a preferred embodiment of the invention there is included in the imaging medium an adhesive such as a pressure-sensitive or heat-activated adhesive. The heat-activated adhesive is capable of being activated at a thermal activation energy lower than that ($E_1$) required to cause the color change in the color-change element so that the transfer of the color-change element is effected by heating and transferring the color-change element above the thermal activation energy of the adhesive. Typical suitable adhesives include Aeroset 3240, a pressure-sensitive acrylate polymer available from Ashland Chemical Co. and low Tg styrene-butadiene latex polymers such as Genflo 3003 and Genflo 3056 available from Omnova Chemical Co.

The adhesive may be provided as a separate layer overlying the color-change element or may be present in at least part of the color change element itself. For at example, if the color-change element comprises two discrete layers each containing one of the color-forming reagents, the adhesive may be present only in the "upper" layer, i.e., the layer remote from the substrate. In some cases it may be desirable to provide a strip layer disposed between the substrate and the color-change element of the imaging medium such that upon transfer of the color-change element to the receiving sheet, separation of the color-change element from the substrate occurs by separation at the strip layer. It may also be desirable to provide a heat-resistant layer on the surface of the substrate opposed to that carrying the color-change element to improve the thermomechanical stability of the medium during printing and/or to prevent the imaging medium from sticking to the thermal head during imaging.

When the thermal recording system of the invention is used to form a continuous image (i.e., a photographic or similar image, which covers essentially every pixel within the image area, without any large gaps), it is preferred that the whole of the continuous image area of the color-change element, including both colored and uncolored pixels, be transferred "bodily" to the receiving sheet; this type of transfer is usually called "panel transfer". Panel transfer of the color-change element avoids problems inherent in pixel-by-pixel transfer, for example (a) the variation in pixel size between isolated pixels, in which none of the adjacent pixels are transferred, and conjoined pixels, in which several adjacent pixels are transferred together; and (b) in fall color images, variations in the image caused by differences in the number of color-change elements present at various pixels. If a CMY or CMYK image is formed by one of the present processes using panel transfer of the color-change elements, three or four color-change elements may be present at each pixel within the continuous image area, and experiments indicate that the presence of these multiple color-change elements is not objectionable to the eye. Panel transfer also produces an image with good appearance and mechanical properties, such as uniform gloss and good scratch resistance.

As will be apparent to those skilled in the imaging art, when the method is used to prepare a color image, it will be necessary to use a plurality (typically three or four, depending upon whether a CMY or CMYK method is required; the present method can also use a larger number of colors, for example in a six, CCMMYY, or eight, CCMMYYKK, process) of imaging media capable of forming differing colors, and to transfer the color-change elements of the plurality of media to a single receiving sheet. Thus, typically in the imagewise-heating method of the invention, after the (first) color-change element has been transferred to the substrate, there is provided a second imaging medium comprising a second substrate carrying a second color-change element. This second color-change element comprises a third layer or phase comprising a third color-forming reagent and a fourth layer or phase comprising a fourth color-forming reagent, the third and fourth reagents being capable of reacting, upon heating of the medium, to cause a change in the color of the second color-change element, this color-change of the second color-change element being different from that of the (first) color-change element containing the first and second reagents. The method includes the further steps of transferring the second color-change element from the second substrate to the receiving sheet so that at least part of the second color-change element is superposed on at least part of the first color-change element already on the receiving sheet.

Referring now to FIG. 1 there is seen a thermal imaging medium 10 comprising a substrate layer 11 carrying a color-change layer 12 which is brought into contact with a thermal print head 14 which includes a heating element 16, typically a resistor, having a length, l, in the print direction. According to the invention, the thermal print head applies heat imagewise to areas of the imaging medium 10 which are not, at the time of such imagewise heat application, in contact with the receiving element 18. Further according to the invention, at the time of such imagewise heat application to the imaging medium 10 there exists an air gap between surface 19 of the color-change layer 12 and the receiving element 18. Since air is a good electrical insulator less thermal energy is required to provide the requisite temperature to cause the color-forming reagents in the color-forming layer to react to produce a color change in the areas of the layer where the thermal energy is applied. As noted previously, the imaging medium 10 is held in firm contact with the surface of the thermal print head 14 by tension. At the point where imagewise heat is applied to imaging medium 10, the area of the imaging medium receiving such thermal energy is not in contact with any other part of the imaging apparatus.

As previously described, according to the invention the distance between the image generation point 20 where any specific area of the imaging medium is imaged by the thermal printing head and the image transfer point 21 where that specific area of the imaged thermal image-forming material is transferred to the receiving sheet is selected such that the effect of the receiver material upon the thermal energy needed to cause the thermal image-forming material to attain the required imaging temperature is substantially avoided. In a preferred embodiment of the invention transfer of the thermal image-forming material occurs as a result of the residual heat remaining in the thermal transfer material at the time of transfer. In another preferred embodiment of the invention a heat source such as a line heater may be incorporated in the print head to apply heat to the imaging medium in the vicinity of the image transfer point to assist the transfer of the thermal image-forming material. In accordance with preferred embodiments of the invention the distance, D, between the center (½ l) of the surface of heating element 16 and the image transfer point 21 where the same imaged area of the thermal color-change layer 12 is transferred to the receiving element 18 is from about 2 l to about 6 l. Typically, for known thermal imaging materials and methods, l is is the range of from about 110 $\mu$m to about 200 $\mu$m and therefore distance D for these preferred embodiments is generally from about 220 $\mu$m to about 1200 $\mu$m. It should be recognized that within this preferred transfer distance range, for particular thermal imaging materials and imaging aparatus there will be an optimum transfer distance range which is further dependent upon the results desired as will be seen in detail in the Examples appearing below herein. Within this optimum distance the thermal color-change layer 12 can be transferred to the surface of the receiving element 18 by means of the residual heat remaining in the color-change element. After adhesion of the thermal color-change layer is effected to receiving element 18 the substrate 11 may be stripped from the thermal color-change layer 12.

The receiver material 18 may be any suitable material including, for example, paper, polymeric films or other material and may be translucent, opaque or transparent.

In the preferred embodiment illustrated in FIG. 1 thermal print head 14 is arranged at other than a perpendicular orientation (hereinafter referred to as "off-axis") to the plane of travel of the receiving sheet 18. Angle a, as illustrated in FIG. 1, is formed by a line perpendicular to the surface of heating element 16 and the line perpendicular to the receiver material 18 at the image transfer point. Preferably, angle a is from about 10° to about 20° and particularly preferably about 15°.

In the preferred embodiment illustrated in FIG. 1 the thermal color-change layer 12 is laminated to the receiver material 18 by operation of the print head 14. As mentioned previously, the imaging medium 10 is held firmly in contact against the printing head 14 by tension. In a preferred embodiment the appropriate tension may be obtained by passing the imaging medium over a suitably positioned roller 40 (see FIG. 2).

According to this preferred embodiment of the invention the thermal color-change layer can be transferred to the receiver material without any appreciable color formation in the $D_{min}$ areas, i.e., background areas. In addition, there is provided the capability to transfer a subsequent, differently-colored thermal color-change layer over a previously transferred thermal color-change layer or layers at full optical density ($D_{max}$) requiring the highest imaging temperature without also transferring the amount of heat which would cause undesired further color changes in the previously transferred thermal color-change layer(s). By imaging the imaging medium with low thermal conductivity air on the backside, relatively low energy levels are required thus making the thermal recording system of the invention particularly well suited for use in portable printing devices.

According to the invention it is possible to improve imaging sensitivity significantly due to the relatively thick air gap which contacts the thermal image-forming material while the latter is subjected to imagewise application of thermal energy. In prior art methods the receiver material, typically paper, and the platen roller surface, typically rubber, diffuse away a significant percentage of the heat generated by the thermal print head. Further, the method provides improved image granularity for transfer to plain paper receiver sheets as well as allowing image generation for each differently colored image layer without cross-talk to underlying unfixed image layers previously transferred to the receiving material.

Figure 2:
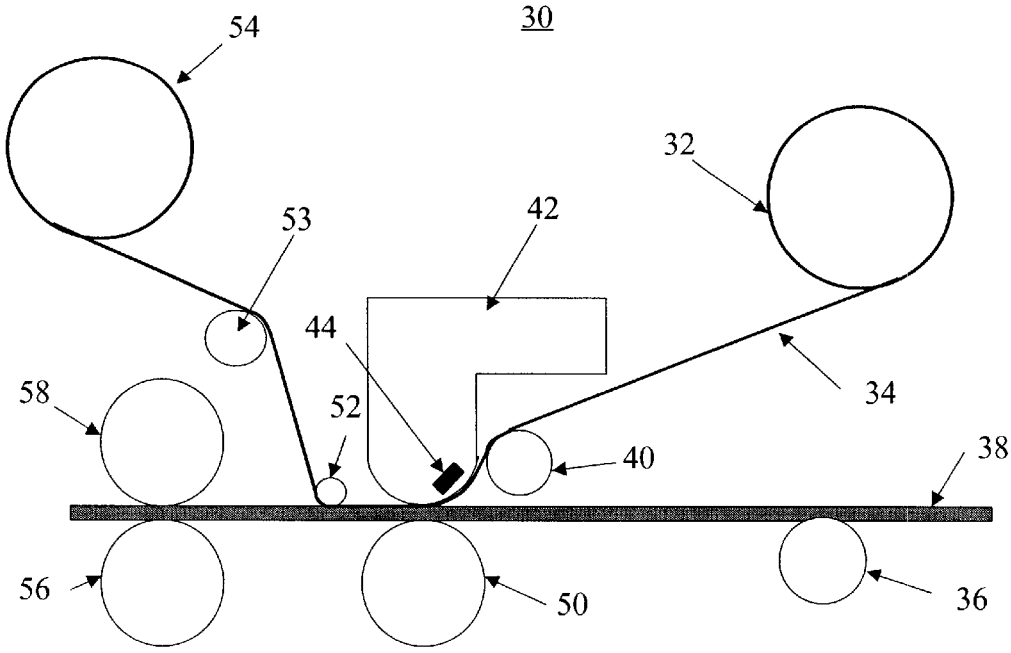
FIG. 2 is a partially schematic side view of an apparatus for carrying out an embodiment of the invention.

There are also described according to the invention embodiments for ensuring reliable contact between the imaging medium and the thermal print head without the need for pressure from the receiver sheet or a platen roller. Referring now to FIG. 2 there is illustrated a preferred arrangement of an apparatus for carrying out the method of the invention wherein the thermal printing apparatus, generally designated 30, comprises a drum 32 mounted for rotation and provided with retaining means (not shown) for retaining a sheet of a thermal imaging medium 34 thereon. It should be noted that the thermal imaging medium 34 can also be provided in the form of individual sheets arranged in a tray. Also seen is a drum 36 mounted for rotation and provided with retaining means (not shown) for retaining a sheet of receiver material 38 thereon. The receiver material may be any suitable material including, for example, paper, polymeric films or other materials and may be opaque, translucent or transparent. Imaging medium 34 is advanced past tension roller 40 into contact with thermal print head 42 which includes heating element 44. Imaging medium 34 is heated in imagewise fashion by heating element 44, and brought into contact with receiver sheet 38 between thermal print head 44 and an opposed platen roller 50.

In cases where it is desirable to transfer the imaging material layer only (such as color-change layer 12 in FIG. 1) the substrate of the thermal imaging medium 34 is stripped from the thermal image-forming material layer by peel bar 52, advanced around peel angle guide bar 53 and wound onto take-up roller 54. Receiving sheet 38 carrying the imaged thermal image-forming material layer is guided past capstan roller 56 and pinch roller 58. In FIG. 2 the capstan roller 56 is shown guiding the receiver sheet 38 through each pass for each color. During retraction of the receiver sheet for secondary and tertiary colors the platen roller 50 would be separated from the thermal imaging head 42.

The method of the invention may be used to form any type of thermal image including, for example, continuous tone images, colored images, black and white images, labels such as bar code labels and shipping labels and identification documents. In a preferred embodiment of the invention an imaging medium comprising a substrate carrying an imaging layer or layers and an adhesive layer overlying the imaging layer(s) is utilized and after the image is formed the entire imaging medium is affixed to a receiver material with the adhesive layer. In this manner there is obtained an image which has the substrate as an outer protective layer.

It should be recognized that although the invention has been described in detail with reference to the embodiment wherein the entire imaged thermal color-change layer is transferred to a receiver material, in other embodiments the entire imaging medium or only the imaged areas of a thermal image-forming layer can be transferred to a receiver material.

EXAMPLES

The invention will now be described further in detail with respect to specific preferred embodiments by way of examples it being understood that these are intended to be illustrative only and the invention is not limited to the materials, procedures, amounts, conditions, etc. recited therein.

A flexible thermal head printing fixture was used to carry out the experiments described in the examples. The fixture comprised an edge printhead pressing on a rubber platen roller, a capstan and nip roller paper drive, a mechanical mount which allowed printing at different speeds (<~2 inches/second), variable tension donor supply and take-up spools, an electronic printed circuit board with Field Programmable Gate Array for providing pulse width modulation of the electronic current to the printhead resistors (with microsecond control capability of pulsewidth), and a computer with software for transferring the image data to the printer and providing overall control of the printing fixture.

The edge printhead, manufactured by Kyocera Corporation (Model # KDE-57-12MGL2), had 300 resistors/inch, with each resistor measuring 70 $\mu$m (micrometer) width and 140 $\mu$m length in the printing direction. The resistors were arranged on a cylindrical bead of ~3 mm diameter. The electronics were kept out of the way of the donor web, thereby allowing the web to wrap around the bead so as to have full access to contact with the resistors.

The relationship between the printhead and platen roller can be characterized by the angle, a, of the printhead from vertical, and the distance, t, between the printhead axis of rotation and the axis of rotation of the platen roller (see FIG. 1). A geometrical calculation provided the distance between the image generation point (point of heating and subsequent colorization of the image layer), and the image transfer point (where full contact is made between the printhead edge, the paper receiver material and the platen roller); this calculation defined the Imaging Shift referenced in FIGS. 3–5.

The imaging media comprised an approximately 3.5 $\mu$m thick poly (ethylene terephthalate) film carrying a color-change layer which included a leuco dye in conjunction with an acid developer material.

Further, a study of the effect of electronic pulse on transferred image density was conducted. Both a uniform pulse pattern (labeled "UN" in FIGS. 3–5) and a front-weighted pulse pattern (labeled "FP" in FIGS. 3–5) were applied.

Example I

Figure 3:
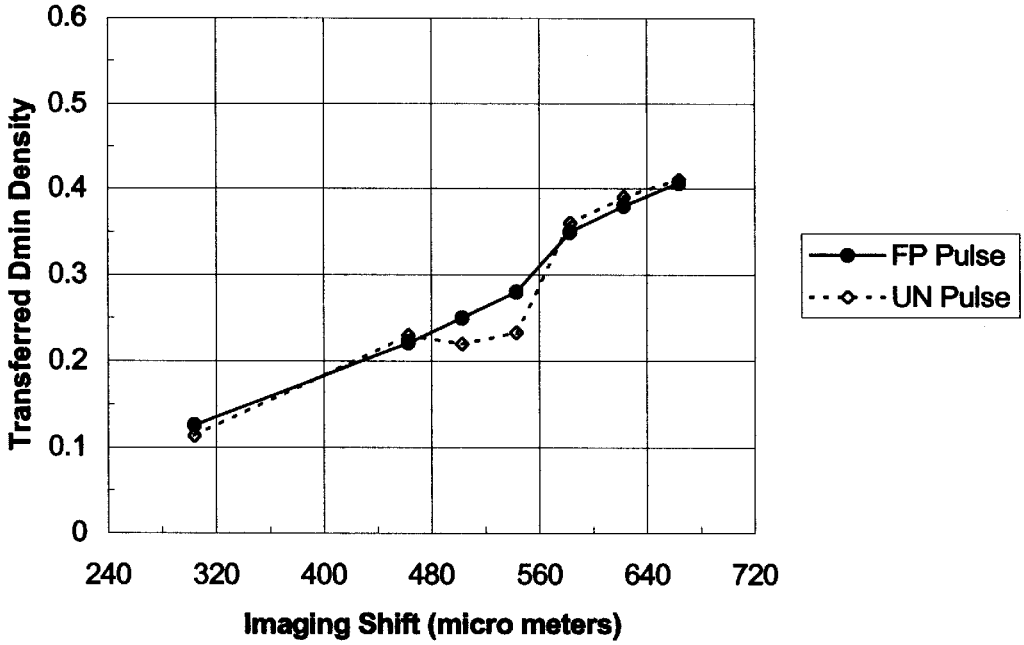
FIG. 3 is a graphical illustration of transferred $D_{min}$ density as a function of the distance, for a particular thermal imaging medium, from the image generation point to the image transfer point of the image formed in the thermal imaging medium to a receiver material.

This example, describes experiments conducted to study the relationship of the Imaging Shift to the transferred minimum optical density. The results are shown in FIG. 3. It can be seen that as Imaging Shift is increased the minimum optical density of the material that transferred and adhered to the paper receiver material increased. This is thought to occur because the image layer requires a minimum temperature in order to transfer. As the transfer point increases in distance from the hot resistor element, the printhead glaze is cooler. In addition, as the transfer point increases in distance from the image generation point, the imaged donor web continues to cool. Therefore, in order to transfer at a given temperature for adhesion, the donor must first have been heated to a higher temperature. The higher imaging temperature can cause a potential increase in colorization or density as shown in FIG. 3. It can also be seen that there was little difference between the uniform and front-weighted pulsing schemes.

Example II

Figure 4:
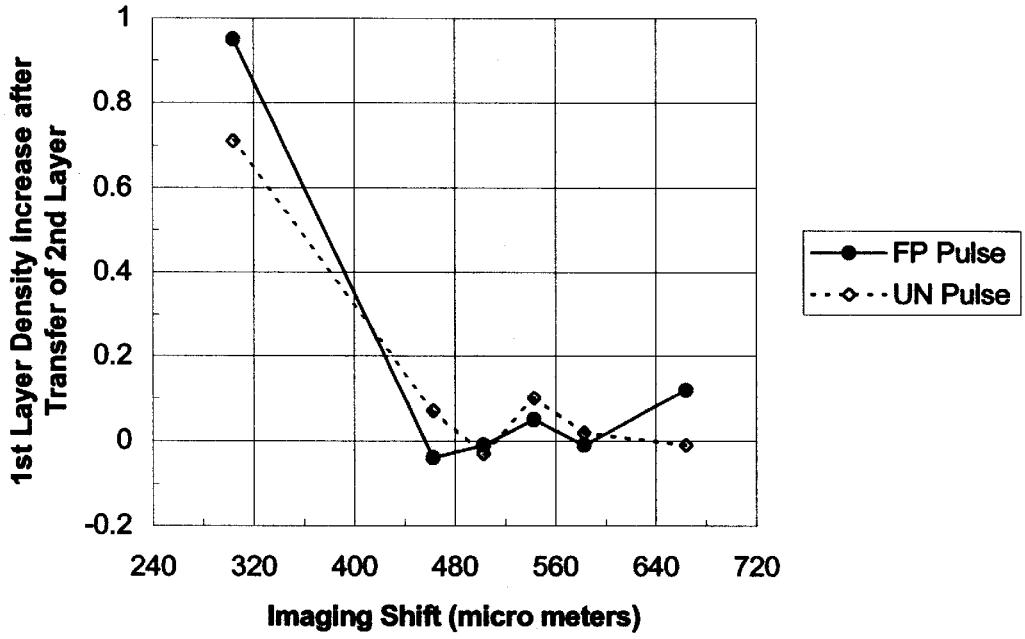
FIG. 4 is a graphical illustration of the density increase of a first color change layer transferred to a receiver sheet after a second color change layer is transferred over the first color change layer.
Figure 5:
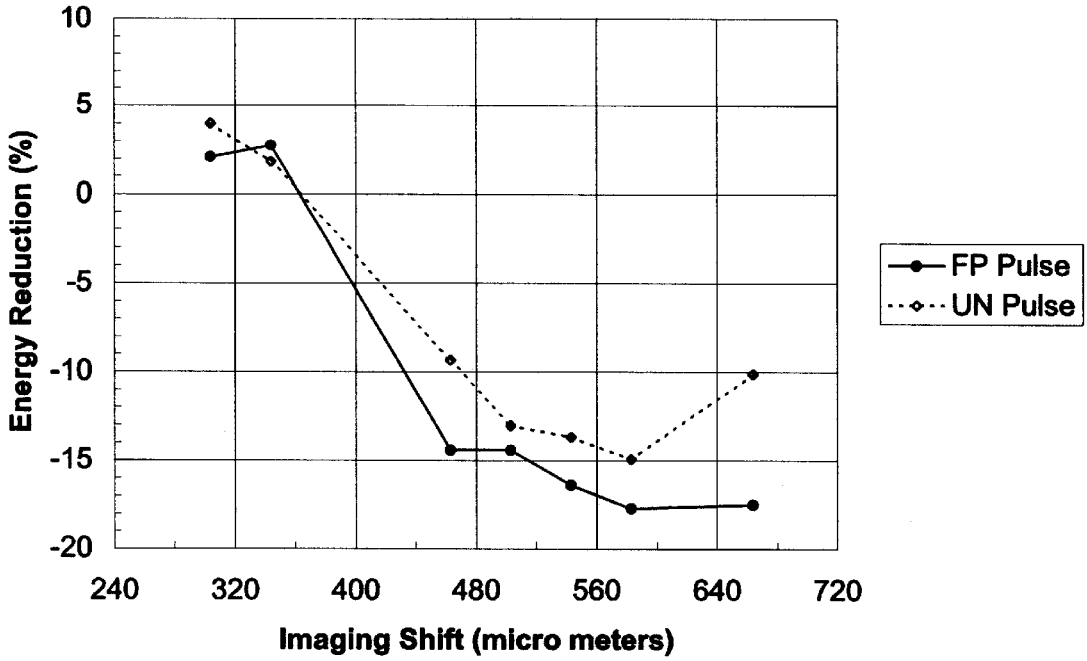
FIG. 5 is a graphical illustration of energy reduction as a function of the distance from the image generation point for a thermal imaging medium to the image transfer point of the imaged thermal imaging medium to a receiver material.

This example describes experiments carried out to study the relationship of the Imaging Shift to the optical density of a first color change layer transferred to a paper receiver material as a result of a second color change layer being transferred to the receiver over the first color change layer. The results are shown in FIG. 4. It can be seen that for Imaging Shifts <400 $\mu$m, the color of the first layer underwent an undesirable color shift ($\Delta$OD~10D) during transfer of the second color layer. This would apear to be because the second layer has high residual temperature (from printing at maximum densities) and because the hot resistor is physically close enough such that heat transfers directly through the air gap to further colorize the first layer. For Imaging Shifts ~450 $\mu$m or greater it can be seen that there was no interaction, or crosstalk, between the first and second color change layers. It can also be seen that there was little difference in the results obtained from the uniform and front-weighted pulsing schemes.

Example III

This example describes experiments to study the energy savings to print Dmax as a function of Imaging Shift. It can be seen that for Imaging Shifts <400 $\mu$m little energy savings were obtained due to the physical closeness and the interaction between the donor and receiver materials. However, for Imaging Shifts of about 450 $\mu$m or greater a significant (approximately 20%) savings in energy is obtained due to the insulating effect of the air on the backside of the donor web as any point on the web was imaged. Again, as in the other examples, there was little difference between the uniform and front-weighted pulsing schemes.

It can be seen that for the imaging medium and imaging apparatus used in Examples 1–3, the optimum transfer distance, D, is in the range of from about 450 to about 550 $\mu$m.

Example IV

A full color image was prepared using the printing apparatus described above with a printhead pressure of about 2 lbs/linear inch and the heating element of the printhead arranged at an angle, a, of about 15° to the receiving sheet at the image transfer point. Each imaging medium comprised an approximately 3.5 $\mu$m thick poly(ethylene terephthalate) substrate carrying an approximately 0.25 $\mu$m thick wax release layer, a color-change layer and an approximately 3 $\mu$m thick pressure-sensitive adhesive layer adhered to the surface of the color-change layer. Cyan, magenta and yellow imaging media were imaged in accordance with the method of the invention and cyan, magenta and yellow color-change layers were transferred successively to a paper receiving sheet with an Imaging Shift of about 500 $\mu$m. There was obtained a low granularity, photographic-quality, variable density image with negligible crosstalk between the successively deposited imaged color-change layers.

Although the invention has been described in detail with respect to various preferred embodiments thereof, those skilled in the art will recognize that the invention is not limited thereto but rather that variations and modifications are possible which are within the spirit of the invention and the scope of the appended claims.

What is claimed is:

1. A thermal imaging method comprising (a) bringing a surface of a thermal imaging medium comprising a thermal image-forming material into contact with the surface of a thermal printhead and applying an imagewise pattern of thermal energy to said thermal imaging medium, wherein, in the areas of said thermal imaging medium receiving said imagewise pattern of energy, the surface of said thermal imaging medium remote from said surface in contact with said thermal printhead is in contact only with air during application of said imagewise pattern of thermal energy, wherein said thermal printhead includes a heating element having a surface of length, l, in the print direction, and (b) transferring at least said imagewise-heated areas of said thermal image-forming material to a receiver material whereby an image is formed on said receiver material, wherein the distance, D, from the imagewise application of thermal energy to said thermal imaging medium to the transfer of said imagewise heated areas of said thermal image-forming material is from about 2 l to about 6 l, measured from the center, ½ l, of said heating element.

2. The thermal imaging method as defined in claim 1 wherein said thermal imaging medium comprises a substrate carrying a layer of said thermal image-forming material.

3. The thermal imaging method as defined in claim 2 wherein said thermal imaging medium further includes a layer of an adhesive material overlying said layer of thermal image-forming material.

4. The thermal imaging method as defined in claim 3 wherein said thermal imaging medium further includes a layer of a release material arranged between said substrate and said thermal image-forming material layer.

5. The thermal imaging method as defined in claim 1 wherein said step (b) is carried out without the application of any substantial additional thermal energy.

6. The thermal imaging method as defined in claim 1 wherein said thermal image-forming material comprises a colored material.

7. The thermal imaging method as defined in claim 1 wherein said thermal image-forming material comprises a color-change material.

8. The thermal imaging method as defined in claim 7 wherein in said step (b) said color-change material is transferred to said receiver material.

9. The thermal imaging method as defined in claim 1 wherein D is from about 220 to about 1200 $\mu$m.

10. The thermal imaging method as defined in claim 1 wherein steps (a) and (b) are carried out on a plurality of thermal imaging media, each of which provides a differently-colored image, and said differently-colored images are transferred in succession to said receiver material whereby a multicolor image is formed on said receiver material.

11. The thermal imaging method as defined in claim 10 wherein steps (a) and (b) are carried out on three thermal imaging media which provide a cyan, magenta and yellow image, respectively, and said cyan, magenta and yellow images are transferred in succession to said receiver material whereby a multicolor image is formed on said receiver material.

12. The thermal imaging method as defined in claim 1 wherein a line perpendicular to said surface of length l of said thermal heating element forms an angle of from about 10° to about 20° with a line perpendicular to said receiver material at the image transfer point.

13. The thermal imaging method as defined in claim 12 wherein said thermal imaging medium comprises a substrate carrying a layer of said thermal image-forming material.

14. The thermal imaging method as defined in claim 13 wherein said thermal imaging medium further includes a layer of an adhesive material overlying said layer of thermal image-forming material.

15. The thermal imaging method as defined in claim 14 wherein said thermal imaging medium further includes a layer of a release material arranged between said substrate and said thermal image-forming material layer.

16. The thermal imaging method as defined in claim 12 wherein steps (a) and (b) are carried out on a plurality of thermal imaging media, each of which provides a differently-colored image, and said differently-colored images are transferred in succession to said receiver material whereby a multicolor image is formed on said receiver material.

17. The thermal imaging method as defined in claim 1 wherein said thermal imaging medium comprises a substrate carrying a thermal image-forming material layer and a layer of an adhesive material overlying said thermal image-forming material layer and wherein in step (b) said imaging medium is transferred to said receiver material.

* * * * *